United States Patent [19]

Skelton

[11] Patent Number: 4,850,611

[45] Date of Patent: Jul. 25, 1989

[54] PRINTED COUPON ENVELOPE FOR TICKETS

[76] Inventor: Vivian G. A. Skelton, 11140 Rockville Pk., Suite L207, Rockville, Md. 20852

[21] Appl. No.: 81,219

[22] Filed: Aug. 4, 1987

[51] Int. Cl.[4] ..... B42D 19/00

[52] U.S. Cl. ..... 251/5; 251/2; 283/81

[58] Field of Search ..... 281/2, 5, 1, 28, 38, 281/29, 15 R; 283/81

[56] References Cited

U.S. PATENT DOCUMENTS

| | | | |
|---|---|---|---|
| 3,734,396 | 5/1973 | Cowan | 283/23 |
| 4,010,964 | 3/1977 | Schechter | 283/56 |
| 4,534,581 | 8/1985 | Engh | 281/5 X |
| 4,636,179 | 1/1987 | Gentile et al. | 402/79 |

*Primary Examiner*—Paul A. Bell

*Attorney, Agent, or Firm*—Armstrong, Nikaido, Marmelstein, Kubovcik & Murray

[57] ABSTRACT

A foldable container for tickets, and the like, purchased in advance and for advertisement and promotional materials for goods and services of the ticket purchaser's interests. The foldable container includes a plurality of panels of paper, paperboard, or similar material suitable for printing joined by a weakened hinge line, such as by perforation, embossing or scoring, one panel having a flap at its bottom edge and being larger in width than the adjoining panels. The adjoining panels progressively decrease in width from the panels to the right and left side of the one panel having a flap to the outermost panel at each side which are the smallest panels in the progression. One or more sides of the panels are printed with advertisement or promotional material, which may contain coupons. The panels are detachable from each other along the weakened hinge lines.

10 Claims, 5 Drawing Sheets

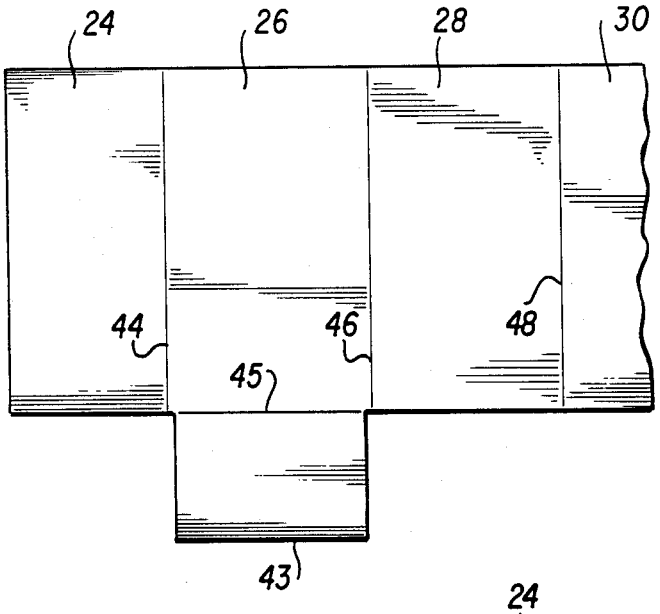
FIG. 12
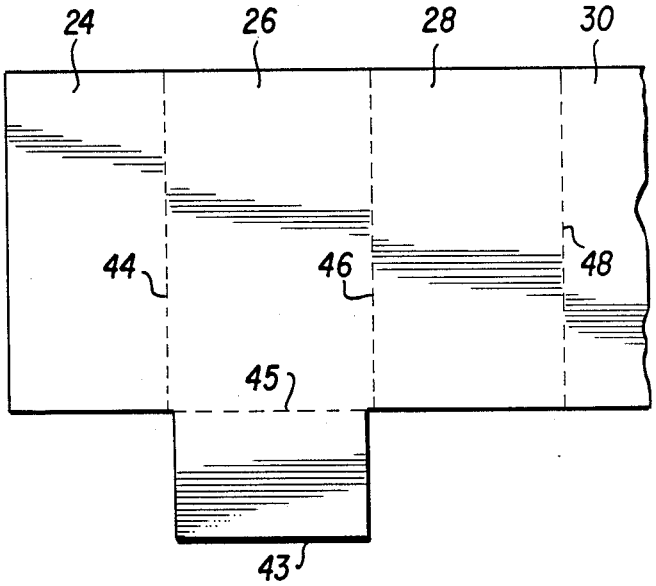
FIG. 13
FIG. 16
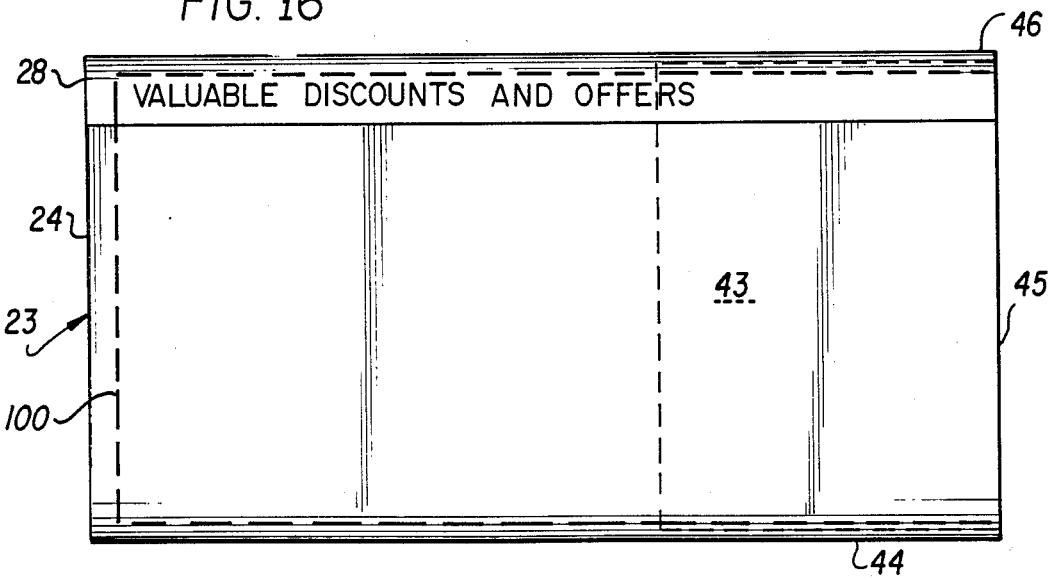

PRINTED COUPON ENVELOPE FOR TICKETS

BACKGROUND

1. Field of Invention

This invention relates to a container for tickets purchased in advance for movies, theatre, sporting events, and the like, which includes advertisements and promotions for related enterprises, such as, restaurants, hotels, music stores, parking facilities, and the like, directly or indirectly associatable with the activity for which such tickets have been purchased in advance or with the person or persons making such purchases or who might use such tickets.

2. Description of Prior Art

Heretofore it has been common practice in the purchase of tickets, especially for entertainment and sporting events for such tickets to be delivered to the purchaser or the user of such tickets in an envelope, or to provide the purchaser with an envelope in which to retain his/her tickets safely until the event.

Such envelopes presented to the purchaser often have various forms of advertising printed on the envelope, sometimes of a forthcoming entertainment event or promotion of a restaurant, or the like.

However, such envelope only serves the purpose of retaining the purchases tickets and such advertisement is lost or ignored.

The container for tickets of the present invention presents the advertisements in such a fashion that such advertisement is not lost nor can it be ignored and affords the recipient the opportunity of utilizing discount coupons before or after the ticketed event.

In order for an advertiser to achieve a reasonable return on discount coupons a very large distribution is normally required. This is quite often achieved via direct mail magazine pop-up inserts, or free standing inserts placed in newspapers. However, the advertising investment required to achieve a reasonable redemption rate on the coupons is indeed very high because of the difficultly in segmenting the target market for the product/service advertised.

In the instant invention, the target market for the advertising is segmented by the event being ticketed. Thus, if the event is a theater production, the advertisements on the ticket container can be directed to products and services to which attendants to theater productions are most likely to be drawn. If, on the other hand, the event being ticketed is a sports event, such advertisements may be directed to products and services more appealing to the sports fan. Because through the ticket container vehicle of the invention, the target market is more accurately defined, the cost to the advertiser are decreased and the returns on advertising should be better!

OBJECTS AND ADVANTAGES

The ticket container of the instant invention provides a new and useful container which will not only retain the tickets booked for the event, but also provides at the same time, advertisers with an advertising medium directed to selected consumer interest.

It is a further object of this invention to provide an advertising medium for the benefit of the recipient in that the holder can redeem coupons included in the advertisements.

Another object of this invention is to save costs of printing ticket envelopes by passing these costs on to the advertisers who choose to advertise on this new media of advertising.

Still another object is to make this form of advertising for restaurants and the like, more attractive in price to alternative forms of advertising so that it will be more cost effective for the advertiser.

It is also an object of this invention to provide a ticket container or envelope which is simple in construction and which can be made with existing machinery.

A further object of this invention is that the ticket holder will not only retain the envelope or container for holding the tickets for the event booked, but also utilize such envelope or container in order to obtain coupon discounts offered, not only before the event, but also within a reasonable time thereafter.

It is also an object that the advertiser will only advertise in the area of his choice within defined geographical boundaries thus saving him more money.

It is an object to keep the weight of the container or envelope to a minimum and although slightly heavier than the envelop presently provided, the increased weight will be outweigh by the savings to the consumer.

It is a further object that the proposed container or envelope will fit conveniently into a pocket or handbag. When folded, it will be almost identical in size to what is presently provided, i.e. about 1 inch larger in width and length of a U.S. one dollar bill.

It is a further object to include the ergonomic feature in that once the recipient has used this new proposed container or envelope he will realize the advantage it has.

It is an object of the invention to have durability so that it not only protects the tickets better, but also that it will have a lifespan of a reasonable time so that the consumer can take advantage of the advertised incentives.

It is still another object that this envelope is unique in that it also has value in the way of coupons and will therefore not be discarded until it has been utilized to it's fullest.

Still a further object is to save the consumer more money by utilizing the coupons.

It is an object of the invention that it has aesthetic appeal so that it will be properly utilized.

Another object of the proposed container or envelope is that it be distributed through all kinds of reservation agencies and thus decrease the cost of distribution as much as possible.

BRIEF DESCRIPTION OF INVENTION

The ticket container or envelope of the instant invention includes a plurality of panels, joined side-by-side along parallel adjoining edges to form a plurality of joined panels joined or connected to each along the adjoining edge by a perforated, embossed, or scored line so that the panels might be folded, one over the other, and, for purposes later described, may be severed and separated, one from the other, along the perforated or embossed line. The panels are formed and the edges perforated or embossed from a strip of heavy paper or light paperboard having opposite faces finished for printing. One panel, referred to herein as the ticket panel, is wider in width than the other panels to which it is joined and is provided, at its bottom, with a flap joined to such panel by a perforated or embossed line at the bottom edge of the panel hinging such flap to the bottom of the ticket panel for hinging and folding over the such bottom edge onto the ticket panel for retaining a ticket placed on such ticket panel. Preferably, such flap is slightly narrower than the width of the ticket panel. The panels joined to the ticket panel, to the right and left of such ticket panel, decrease in width in progression away from such panel, the amount of such decrease depending upon the thickness of the paper or light paperboard from which the ticket container or envelope is made. Such decrease in width allows such panels to be folded, one over the other without the panels binding or bulging. Thus, when folded with the ticket therein, the ticket container or envelope of the instant invention lays flat. In the preferred embodiment of the invention, a plurality of panels are to one side of the ticket panel and are folded, one panel over the other, from the outermost panel until such panels are folded over the ticket panel and the ticket thereon. The single panel at the other side of the ticket panel is then folded over the folded panels to form a cover over the container or envelope the same size as the upper-most folded panel or, for reasons later described, narrower than the upper-most folded panel to leave a strip exposed thereon for printing.

The face of each panel, when the panels are unfolded, has printed thereon and advertisement and, if the advertiser chooses, includes in such advertisement a coupon for discount of the advertiser's goods. Such ads may appear on one or both sides of each panel. For redemption purposes, such advertisements which include coupons are separated by the adjoining panels by the perforated or embossed lines joining the panels. Panels which are separated and not used, for example, a panel outward of a panel where and advertisement coupon has been used, may be placed under the flap on the ticket panel for storage for later use at the holder's convenience.

DESCRIPTION OF DRAWINGS

The invention will be better understood from the following description of a preferred embodiment taken with the appended drawings in which:

FIG. 9 shows the elevation view of the container or envelope of FIG. 9 with the lower flap (which will subsequently hold the tickets) being folded in, FIG. 10 is a further elevation view of the panels and flap now covering the tickets and protecting them;

FIG. 11 is the elevation view of the final step where the front panel is closed to seal the envelope or container;

FIG. 12 is a partial view showing a weakened zone formed by scoring between successive panels and the lower coupon which supports the tickets;

FIG. 13 shows a weakened zone formed by perforations between successive panels and the lower flap which supports the tickets;

FIG. 16 is a plan view of the closed "printed coupon envelope for tickets" showing the relative width of the panels to facilitate ease of opening and closing.

DESCRIPTION OF INVENTION

Figure 1:
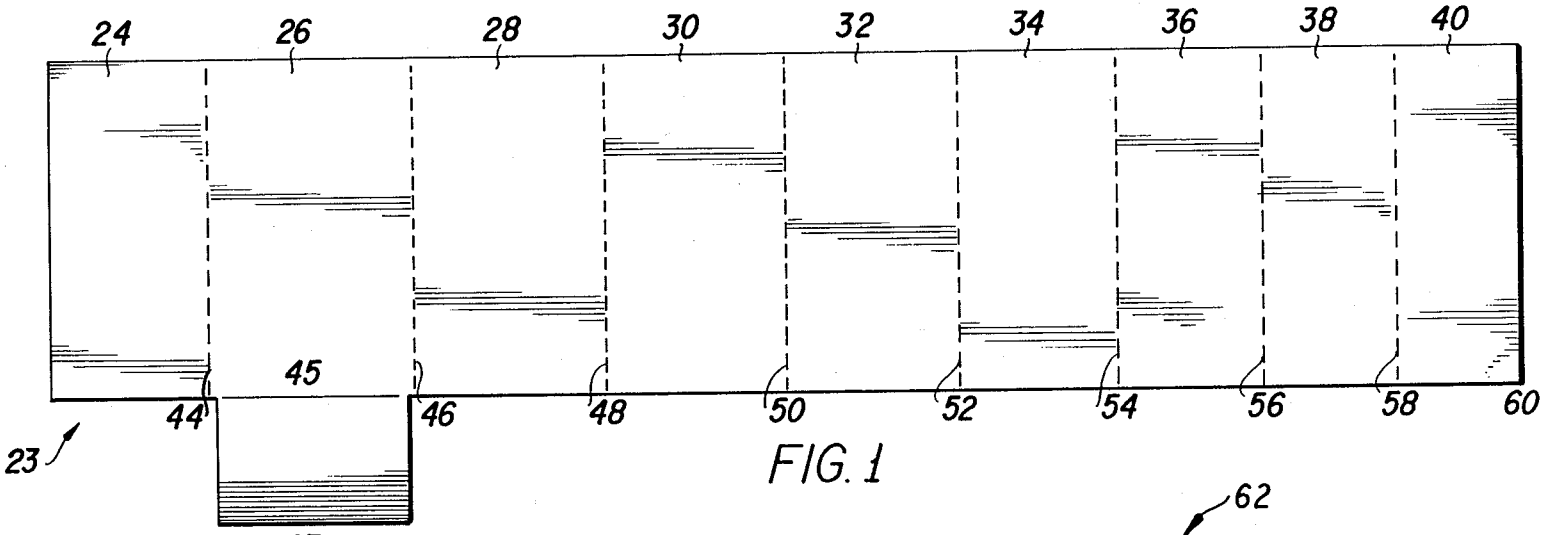
FIG. 1 is a plan view of a container fully opened.

FIG. 1 shows the container or ticket envelope, generally designated in folding, and as the envelope will be seen by the prospective consumer or customer making reservations for tickets, after receipt of the tickets and opening and unfolding of the container or ticket envelope. In the illustrated embodiment, the envelope, 23, is composed of nine individual panels from left to right 24, 26, 28, 30, 32, 34, 36, 38, 40, with a bottom flap 43 attached to ticket panel 26 at the panel base by perforations or embossing at 45 horizontal to the base. Flap 43 which is of the same material as the rest of the envelope, has a slightly smaller width at 45 relative to panel 26 and a perpendicular length about $\frac{1}{3}$ of the length of panel 26. The panels are rectangular and are joined along their abutting edges by perforations or embossed lines to hinge the panels together. The envelope is made of heavy paper stock or paper board suitable for printing. The panels are rectangular with their longer axis hinged together to form, when the panels are folded, a folded container or ticket envelope having a height about twice the folded panel width and a thickness slightly greater than the combined thickness of the paper or paper board from which the panels are formed, the flap and the ticket in the container or folded envelope.

A linear weakened zone is provided between each pair of adjacent panels along the perforated or embossed line. Thus, a zone 44 connects panels 24 and 26; a zone 46 connects panels 26 and 28; a zone 48 connects panels 28 and 30; a zone 50 connects panels 30 and 32; a zone 52 connects panels 32 and 34; a zone 54 connects panels 34 and 36; a zone 56 connects panels 36 and 38; and a zone 58 connects panels 38 and 40. Zone 60 is the end of the container or envelope.

Each weakened zone intermediate the panels is perpendicular to the long axis of the element 23. The zone may be weakened in any manner, such as, by perforating, creasing or scoring the paper or the like of which the element 23 is composed. Zone 45 which is the weakened zone attaching panel 26 to flap 43 is weakened in the same manner as the other zones.

Each of the panels, including the flap may be printed with advertisement materials including redemption coupons, self addressed postage prepaid cards, printed display symbols and the like. Printed redemption coupons, where they are included in the advertisement, provides incentives for the purchase of a product or service at a fixed reduction in price, as indicated on such coupon. The printed display symbols are generally a printed message describing the saleable product or service and may include a picture of the saleable product in the form of a graphic arts illustration, or a photograph or interpretation of the saleable product, and promotional material for increasing sales. A preferable total number of panels is nine as shown, however, other total numbers of panels from three to eight may be utilized. Such panels and flap may be printed on one or both sides.

Figure 2:
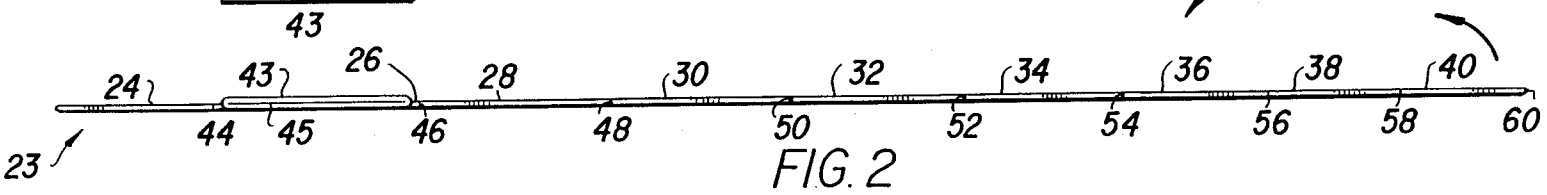
FIG. 2 is is an elevation edge view of the envelope of FIG. 1, the thickness of the paper being exaggerated to better illustrate the invention.

FIG. 2 illustrates the edge and attachment of the panels and flap to form element 23. The thickness of the panels and flap has been exaggerated in this figure in order to illustrate it effectively. Usually the panels and flap will be no thicker than a postcard. The direction of the intended parallel edge to edge folding planned in the present invention is indicated by the curved arrow 62.

Figure 3:
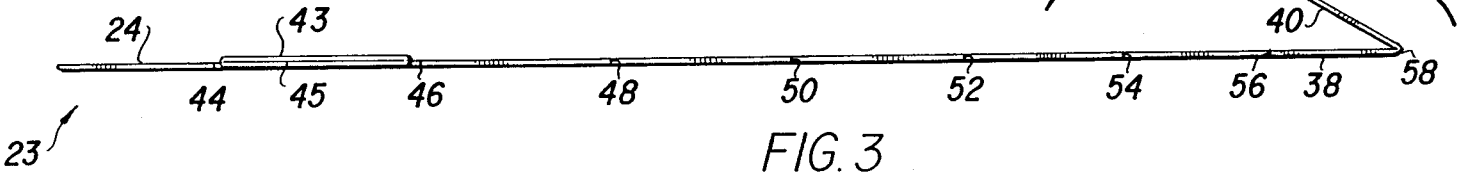
FIG. 3 is a elevation edge view of the envelope of FIGS. 1 and 2 with the first fold made.

FIG. 3 shows the element 23 after the first parallel long edge to long edge fold at the perforated or embossed zone 58 at panel 40 so that the length of the element 23, as folded, has been reduced by the length of the folded panel. The panels are displaced as shown with the endmost panel 40 folded over panel 38. The curved arrow 64 indicates the direction of fold, which is in essence a sequence of folding in which the previously folded endmost fold is folded over its adjacent fold.

Figure 4:
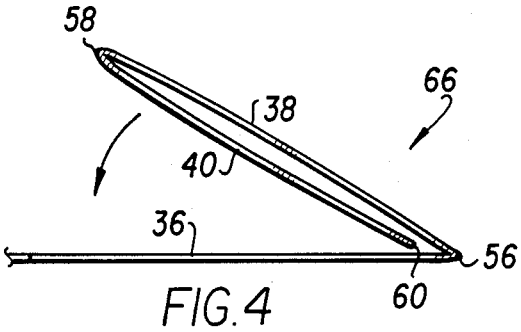
FIGS. 4, 5, 6, 7, 8 are successive views similar to FIG. 3, but showing the envelope in elevation view after progressive folds are made.

FIG. 4 shows the second parallel long edge to long edge fold which is at the perforated or embossed zone 56, at panel 38, so that the length of the element 23, as folded, has been reduced by two panels of the original single thickness length. The panels are displaced as shown with the endmost panel 36 below the panels 40 and 38, respectively. The curved arrow 66 indicates the direction of this parallel long edge to long edge fold.

Figure 5:
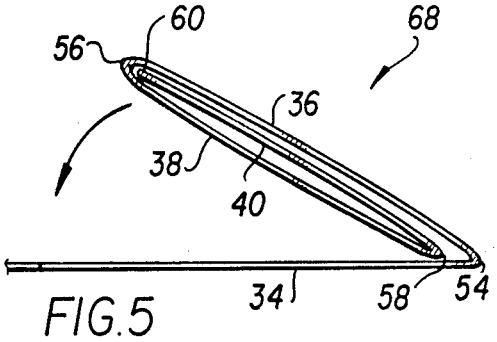

FIG. 5 shows the third long edge to long edge fold which is about zone 54, at panel 36, so that the length of the element 23, as folded, has been reduced by three panels of the original single thickness length. The panels are displaced as shown with the endmost panel 34 below the panels 38, 40 and 36 respectively. The curved arrow 68 indicates the direction of this parallel long edge to long edge fold.

Figure 6:
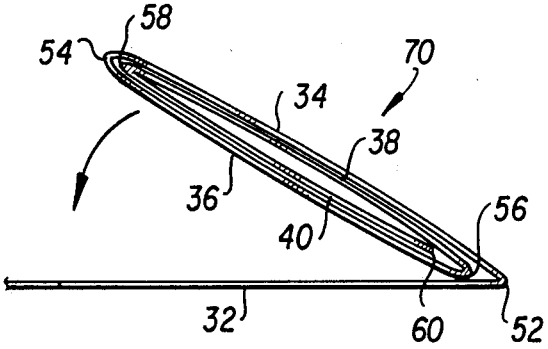

FIG. 6 shows the fourth long edge to long edge fold which is about zone 52, at panel 34, so that the length of the element 23, as folded, has been reduced by four panels of the original single thickness length. The panels are displaced as shown with the endmost panel 32 below the panels 34, 36, 38, 40 respectively. The curved arrow 70 indicates the direction of this parallel long edge to long edge fold.

Figure 7:
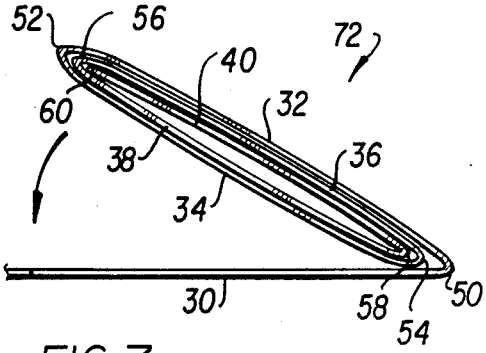

FIG. 7 shows the fifth long edge to long edge fold which is about zone 50, at panel 32, so that the length of the element 23 as folded has been reduced by five panels of the original single thickness length. The panels are displaced as shown with the endmost panel 30 below the panels 32, 34, 36, 38, 40 respectively. The curved arrow 72 indicates the direction of this parallel long edge to long edge fold.

Figure 8:
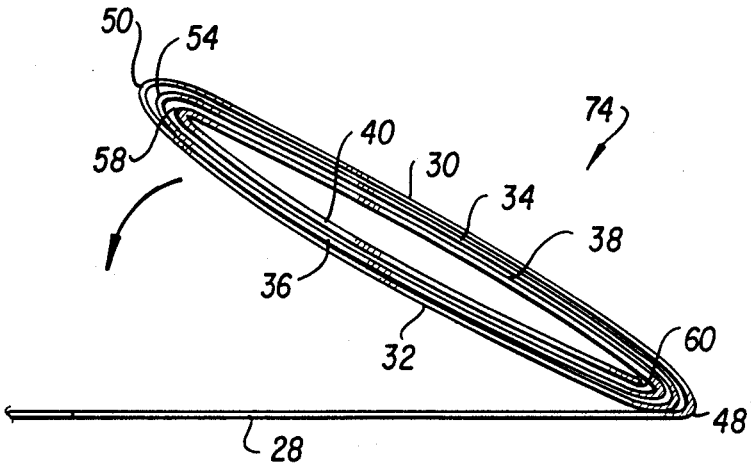

FIG. 8 shows the sixth long edge to long edge fold which is about the wakened zone 48, at panel 30, so that the length of the element 23 as folded has been reduced by six panels of the original signal thickness length. The panels are displaced as shown with the endmost panel 28 below the panels 30, 32, 34, 36, 38, 40 respectively. The curved arrow 74 indicates the direction of this parallel long edge to long edge fold.

Figures 9, 10, 11:
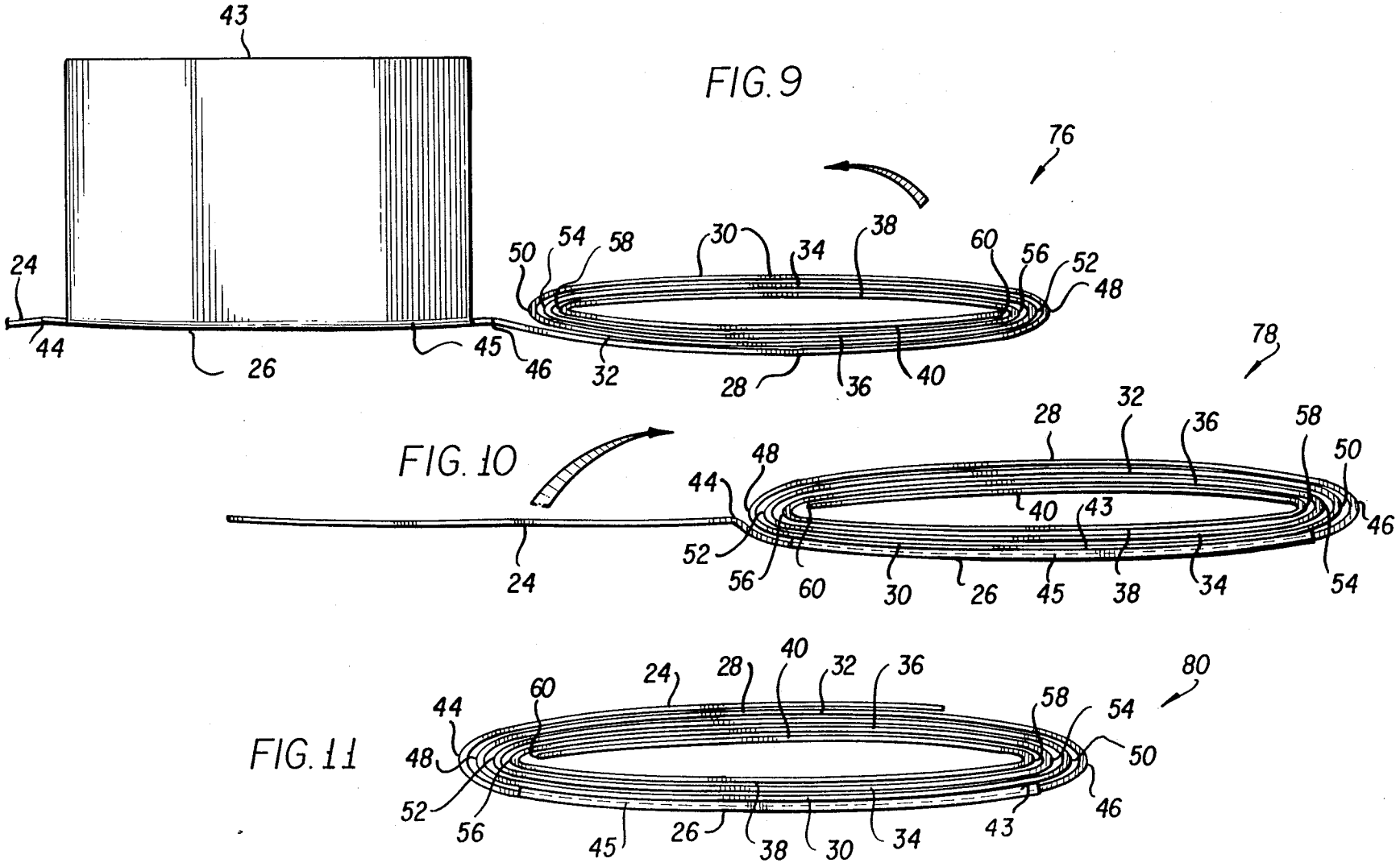

FIG. 9 shows the closure of the flap 43 at zone 45, located between zones 44 and 46, on to ticket panel 26. The curved arrow 76 indicates the direction of the folding of the flap on to panel ticket 26.

FIG. 10 shows the long edge to long edge fold which is about zone 46, at panel 28, so that the length of the element 23 as folded has been reduced by seven panels of the original single thickness length. The panels are displaced as shown with the endmost panel 26 below the flap 43 and panels 28, 30, 32, 34, 36, 38, 40 respectively. The curved arrow 78 indicates the direction of this parallel long edge to long edge fold.

FIG. 11 shows the final long edge to long edge fold which is about zone 44, at panel 24, so that the length of the element 23 as folded has been reduced to one panel of the original single thickness length. The panels are displaced as shown with the panel 26 below the flap 43 and panels 28, 30, 32, 34, 36, 38, 40 respectively. The curved arrow 80 indicates the direction of this parallel long edge to long edge fold. Before flap 43 and panel 24 are folded onto panel 26, the ticket is first placed on panel 26.

FIG. 12 shows three adjacent panels 24, 26 and 28 connected by scorings 44 and 46. In addition, the flap 43 is also illustrated connected by scoring 45 to ticket panel 26.

FIG. 13 shows three adjacent panels 24, 26 and 28 connected by perforations 44 and 46. In addition, the flap 43 is also illustrated connected by perforations 45 to panel 26.

Figure 14:
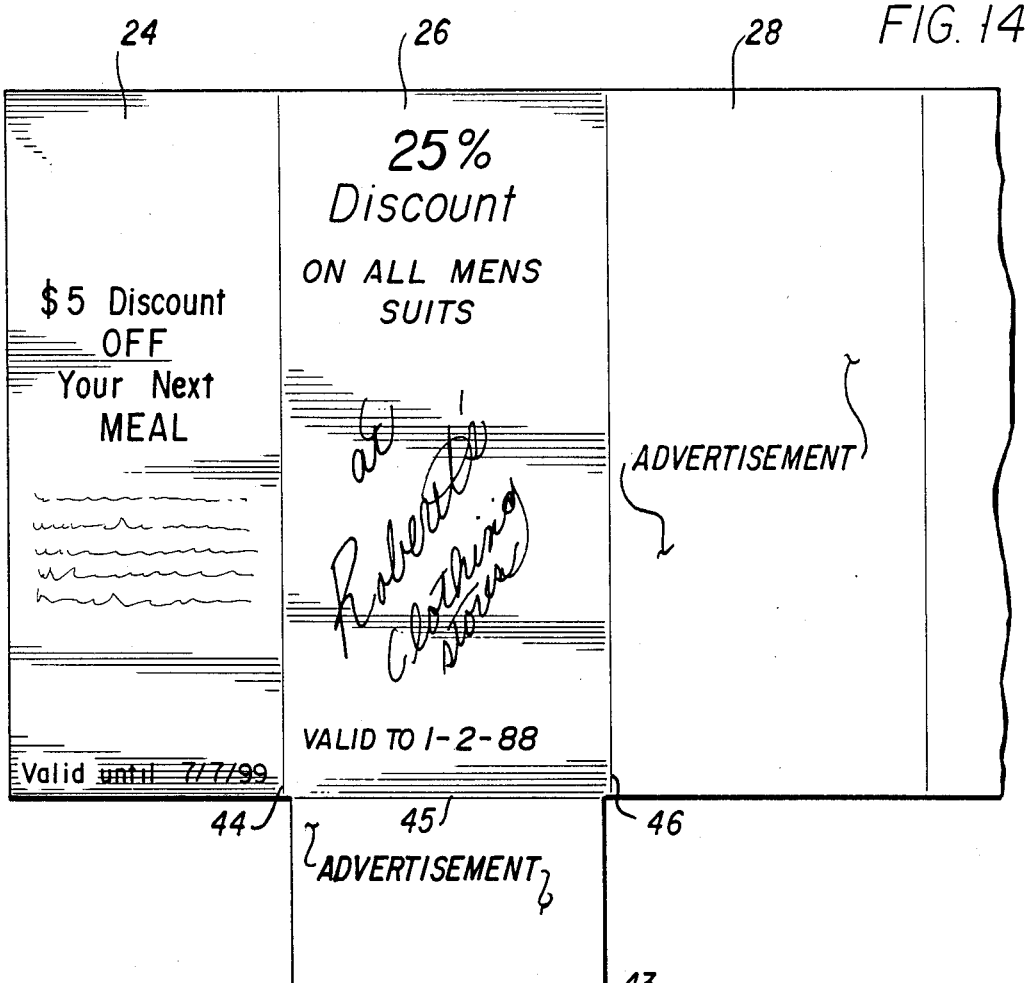
FIG. 14 is an enlarged plan view of three connecting coupons with simulated advertising shown in the panels and showing the hinged arrangement of the panels and the flap which supports the tickets.

With reference to FIG. 14, a typical full scale panel and flap is shown. The coupon 26 may be about 1" longer and 1" wider than a U.S. dollar bill. Graphic symbols consisting of incentive material, trademark for a restaurant, etc. are shown on the body of the panel exclusive of the coupon. Coupon 24 shows a discount offered by a hairstylist. Coupon 28 is a coupon offer on a pizza. Note that all coupons have an expiration date or a validity time period to protect both consumer and advertiser. The flap 43 scored at 45 could advertise the various locations where the public could make reservations.

Figure 15:
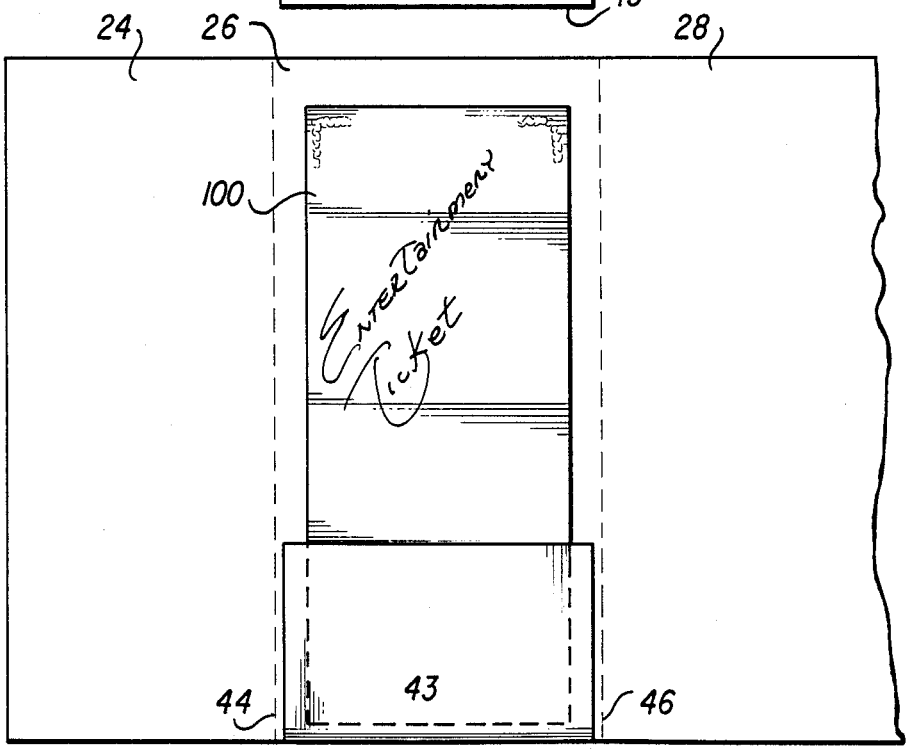
FIG. 15 is a plan view with the reserved ticket placed in the envelope retained or received at the bottom by the lower flap.

FIG. 15 shows element 23 with the entertainment ticket placed inside flap 43 secured by perforation 45 to panel 26.

FIG. 16 shows element 23 finally closed. Panel 24 secured by perforation 44 is narrower in width than panel 28 secured by perforation 46 allowing space for printing of an incentive on panel 28 in the form of a display message.

OPERATION OF THE INVENTION

The present invention provides an improved media for the safekeeping of tickets reserved in advance for movies, theatre, sporting games and the like as well as a promotional medium for the stimulation of sales for goods and service related to the ticketed event, such as, department stores and specialty shops, hotels, motels, restaurants, hairstylists, luggage, car rentals, travel agencies, credit cards, banks, and the like. The media consists of a printed coupon envelope or container constituting a plurality of oblong panels and a securing flap for the tickets reserved. Each panel flap is made of paper, e.g. glossy finish paper, paperboard or similar material suitable for printing. Printing may be included not only on the front, but also on the back of one or more or all of the panels and flap.

The printing on the panels and flap is imperative, since this printing which may include coupons is germane to the result to be accomplished the stimulation of sales for the advertisers. The panels may also include a reply paid postage sales promotion message. Panel 26 interconnected by perforation zones 44, 45 and 46 is ideally suited to this as that panel may be the size required by the post office for postage paid reply cards.

A large spectrum of different products and services may be promoted. Among possible products and/or services to be promoted would include any retail product, restaurant, fast food outlets, video movies, hairstylists, beauty salons, picture processing, travel, vacation resorts, health club, spas, etc.

The safekeeping of tickets reserved in advance is achieved via this embodiment as the flap 43 secured by weakened zone 45 prevents the tickets from falling out of the container or envelope. The flap may also be utilized as a coupon with double sided printing to be redeemed for a special discount or cash redemption where in the same manner as the panels.

The present embodiment is characterized by the arrangement of the oblong panels seratium, with the panels being attached end-to-end preferably at their long edges via individual weakened zones. With reference to FIG. 1, these panels are 24, 26, 28, 30, 32, 34, 36, 38, 40 attached to weakened zones 44, 46, 48, 50, 52, 54, 56, 58, 60.

Flap 43 attached to panel 26 at the weakened zone 45 is slightly narrower in width (approximately ¼ inch) than panel 26 to facilitate closing and to allow the panels to fold easily. In addition, panel 24 may be about half an inch narrower than panel 26, attached to panel 24 at weakened zone 44, to facilitate a promotional message in that ¼ inch space exposed on panel 28, as illustrated in FIG. 16.

Each panel from panel 26 to 28 to 30 to 32 to 34 to 36 to 38 to 40 is approximately 1/10 of an inch progressively smaller in width from panel 26. This facilitates folding of the container or envelope so that when closed it lies flat without an attachment to secure it closed.

Each panel may have a promotional incentive message printed on one or both sides the message may be the same or different on opposite side of each panel. It is also possible that the flap 43 attached to panel 26 by weakened zone 45 could also be used as a promotional medium or discount coupon.

Thus, each and every panel and flap can be utilized before or after the reserved entertainment subject to the terms and conditions printed on the respective panel. Where discounts or coupons are involved a validity period may be indicated with the promotional message. In order for the recipient to utilize the coupon, he simply tears the panel along any of the weakened zones. It thus dislodges from the original container or envelope.

The terms and expressions which have been employed in the foregoing description are used as terms of description and not of limitation and there is no intention, in the use of such terms and expressions, of excluding any equivalents of the feature shown and described or portions thereof, but it is recognized that various modifications are possible within the scope of the invention claimed.

What is claimed:

1. A foldable container for advance sale tickets comprising a plurality of panels joined side-by-side along parallel adjoining edges and interconnected along a weakened line for folding the panels over adjacent panels from the outermost panel inwardly, one of said panels having a flap at its bottom free edge, said flap being joined to said one of said panels along a weakened line for folding said flap over said one of said panels for retaining an advance sale ticket placed on said one of said panels, said plurality of joined panels being of equal height and having a width between said fold lines of progressively decreasing size from said one of said panels having a flap which is the largest width of said panels to the remotest of said joined panels at the opposite sides of said one of said panels, said joined panels at one side of said one of said panels being folded inwardly from said remotest of said joined panels, one panel over the other, onto said flap folded over the face of said one of said panels and the advance sale ticket under said folded flap and said joined panels at the other side of said one of said panels being folded inwardly from said remotest of said joined panels at said other side, one panel over the other, onto said folded panels over said face of said one of said panels.

2. A foldable container, as recited in claim 1 in which said one of said panels having a flap is the second panel of said plurality of panels and said joined panels at said one side of said panel are a plurality of panels folded, one panel over the other and onto the face of said one of said panels, said folded flap and said advance sale ticket under said folded flap and the one panel at said other side of said one of said panels is folded onto said folded panels over said face of said one of said panels for forming a cover substantially completely covering the otherwise exposed face of said folded panels.

3. A foldable container, as recited in claim 2 in which said one panel at said other side of said one of said panels is shorter in width than the width of said panels folded onto said folded panels over said face of said one of said panels.

4. A folded container, as recited in claim 3, in which said shorter one panel folded onto said folded panels over said face of said one of said panels leaves exposed, along the face adjacent the edge of the upper-most of said panels folded over said face of said one of said panels, an exposed strip.

5. A foldable container, as recited in any one of claims 1 to 4, in which one or more of said panels contain on at least one face, thereof, a printed advertisement.

6. A foldable container, as recited in claim 5, in which, at least one of said printed advertisements includes a discount coupon.

7. A foldable container, as recited in claim 6, in which said panels are separable, one from the other, along said weakened lines for folding.

8. A foldable container, as recited in claim 7, in which said weakened lines are lines of perforation.

9. A foldable container, as recited in claim 7, in which said weakened lines are score lines.

10. A foldable container, as recited in claim 7, in which said weakened lines are embossed lines.

* * * * *